United States Patent [19]

Meffert et al.

[11] Patent Number: 4,759,292

[45] Date of Patent: Jul. 26, 1988

[54] SPINSTABILIZED PROJECTILE

[75] Inventors: Wolfgang Meffert; Karl-Heinz Silligmann, both of Düsseldorf, Fed. Rep. of Germany

[73] Assignee: Rheinmetall GmbH, Düsseldorf, Fed. Rep. of Germany

[21] Appl. No.: 5,195

[22] PCT Filed: Mar. 18, 1986

[86] PCT No.: PCT/EP86/00155

§ 371 Date: Jan. 2, 1987

§ 102(e) Date: Jan. 2, 1987

[87] PCT Pub. No.: WO86/06829

PCT Pub. Date: Nov. 20, 1986

[30] Foreign Application Priority Data

May 4, 1985 [DE] Fed. Rep. of Germany ..... 3516102

[51] Int. Cl.[4] ..... F42B 13/12

[52] U.S. Cl. ..... 102/499; 102/275.2; 102/473

[58] Field of Search ..... 102/204, 275.2, 340, 102/342, 351, 357, 473, 487, 488, 499, 481, 505

[56] References Cited

U.S. PATENT DOCUMENTS 2,342,096 2/1944 Zimmerman ..... 102/340

3,368,485 2/1968 Klotz ..... 102/275.2

OTHER PUBLICATIONS

Rheinmetall GmbH publication, "Waffentechnisches Taschenbuch", [Handbook on Weaponry], 4th Edition, (1977), pp. 490–493.

*Primary Examiner*—Harold J. Tudor

*Attorney, Agent, or Firm*—Spencer & Frank

[57] ABSTRACT

A spin stabilized payload projectile 10, in order to separate a projectile base connected with projectile body 11 and to eject a payload 13, is provided with an ejection charge 15 in its nose region, with such ejection charge being activated with a certain delay by a nose fuze 14. To prevent damage to the nose fuze 14 by the gas pressure generated by ejection charge 15, a pressure reducing element 20 is disposed between nose fuze 14 and the ejection charge. In a particularly advantageous embodiment of the invention, this pressure reducing element 20 is composed of a cone or a cone frustum whose base face faces nose fuze 14 and whose tip faces ejection charge 15. The tip of pressure reducing element 20 is provided with an opening 20*a* through which a firing jet travels from nose fuze 14 to ejection charge 15 for the purpose of activating charge 15. After activation of ejection charge 15, pressure reducing element 20 is deformed into a substantially gas tight disc.

6 Claims, 2 Drawing Sheets

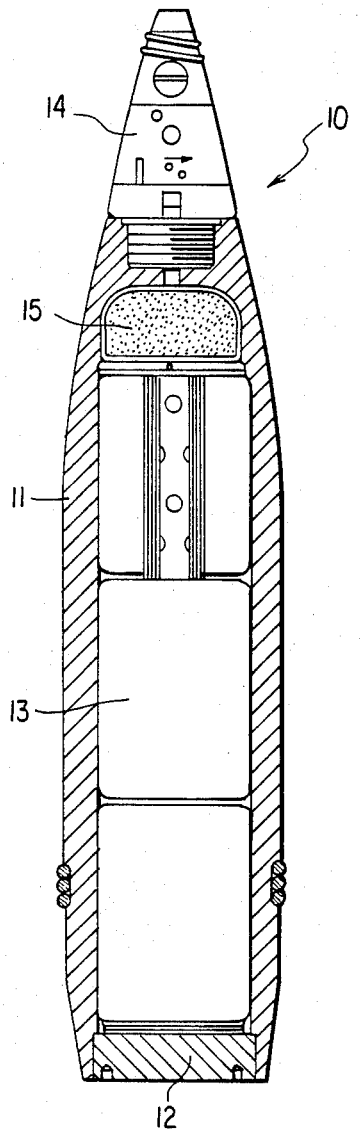
FIG. 1
(PRIOR ART)
FIG. 2
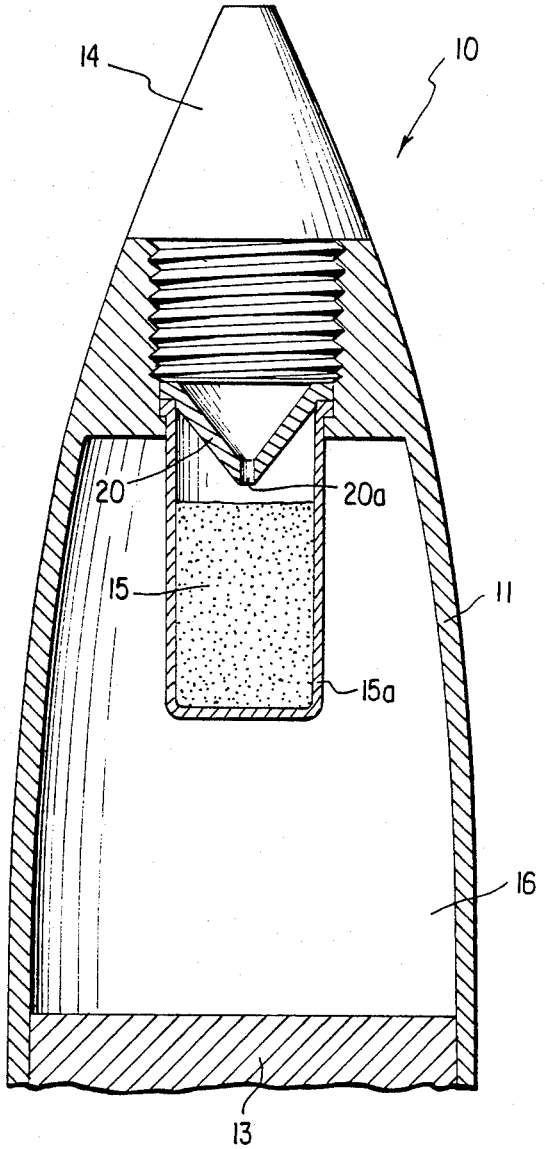

SPINSTABILIZED PROJECTILE

BACKGROUND OF THE INVENTION

The invention relates to a spin stabilized payload projectile of the type which includes a projectile body, a separatable projectile base, ejectable payloads in the projectile body, a nose fuse, and an ejection charge activated by the nose fuse.

Such a projectile is known from "Waffentechnisches Taschenbuch" [Handbook on Weaponry], published by Rheinmetall, 4th Edition, 1977, pages 491 et seq.

In conventional spin stabilized projectiles having ejectable payloads, the acceleration forces are essentially transmitted over the projectile base, with the rotational acceleration being transmitted by way of a suitable, rotationally secured connection between projectile base and projectile body, e.g. rifling or pins. To initiate the ejection of the payload, a nose fuze actuates an ejection charge which builds up a pressure in the interior of the projectile body so that initially the projectile base is exploded away and then the individual payloads are ejected in succession. Since with conventional spin stabilized projectiles, the moments of inertia of the projectile bases were relatively small, relatively small forces were required to separate them when the ejection phase was initiated. These forces could be absorbed by the conventionally introduced nose fuzes without producing a malfunction.

In recent times, spin stabilized projectiles have been developed and introduced which have a longer range and, compared to conventional projectile bases, have a substantially longer and heavier tail section, since this tail section accommodates the propellant required to increase the range. During firing, this propellant is fired by the propellant charge (igniter) and, during flight of the projectile, reduces the range-shortening effect of gravity. The moments of inertia of such enlarged projectile tail sections are sometimes higher by a multiple than is the conventional custom, so that connections between these novel projectile bases and the projectile body must be able to withstand greater mechanical stresses. But, on the other hand, this is a drawback since during ejection, a stronger ejection charge requires the generation of substantially greater forces to separate the projectile base. It has been found that these greater forces have a disadvantageous influence on the conventional nose fuze, so that failures occur and the payload is not ejected in the expected manner.

SUMMARY OF THE INVENTION

It is the object of the invention to improve the configuration of a spin stabilized payload projectile so that, in spite of the higher ejection pressure required for the ejection, the fuze disposed in the nose of the projectile is not subjected to undue stress.

Based on a projectile of the above described type, this is accomplished by disposing a pressure-reducing element between the ejection charge and the nose fuse.

BRIEF DESCRIPTION OF THE DRAWINGS

FIG. 1 is a schematic sectional view of a conventional spin stabilized payload projectile;

FIG. 2 is a sectional view of the nose region of a projectile configured according to the invention.

DESCRIPTION OF THE PREFERRED EMBODIMENT

FIG. 1 is a schematic representation, partially in longitudinal section, of a conventional spin stabilized payload projectile 10 which comprises an essentially hollow cylindrical body 11 and a projectile base 12 connected with this body in a manner secure against rotation. In this body 11, payloads 13 are packed densely one on top of the other to be ejected by an ejection charge 15 at a certain point of the flight path, the ejection charge in turn being actuated by a fuze 14 disposed in the nose of projectile 10. After a delay preselected by the setting of fuze 14, the latter ignites ejection charge 15, which then generates a high gas pressure in the interior of projectile body 11 to initially separate projectile base 12 from projectile body 11 and then eject, in succession, the payloads 13 from the opening now existing in the tail of the projectile.

As mentioned above, in newly developed spin stabilized payload projectiles having tail sections of much greater masses, a mechanically firmer connection must be provided between projectile base 12 and projectile body 11, requiring substantially stronger ejection charges 15 for their separation. In order not to thereby adversely influence nose fuze 14, as is shown in FIG. 2 a pressure reducing element 20 is disposed—between nose fuze 14 and ejection charge 15. This pressure reducing element 20 seals the chamber of ejection charge 15—(at least substantially) against nose fuze 14 so that nose fuze 14 will not be subjected to undue pressure stress.

In a particularly advantageous feature of the invention, pressure reducing element 20 has a cone or cone frustum shape and is disposed between nose fuze 14 and ejection charge 15, lying on the longitudinal axis of projectile 10, so that the base face of the cone or cone frustum is adjacent nose fuze 14, while the tip of the cone or cone frustum is oriented toward ejection charge 15. An opening **20*a* is disposed in the tip of the cone or cone frustum of pressure reducing element 20 through which, upon activation of nose fuze 14, a firing jet passes to charge ejection charge 15. After the firing of ejection charge 15, a rapidly increasing pressure develops in ejection sleeve 15*a* which, according to the principle of explosive deformation, suddenly deforms the conical or frustoconical pressure reducing element 20 and compresses it into a substantially closed disc which—at least for a short period of time—produces a pressure tight seal between noze fuze 14 and the pressure charged payload chamber 16. Due to this pressure tight seal, the ejection of payloads 13 can take place unimpededly without any reduction of the gas pressure required for the separation of the projectile base and ejection of the payloads due to leakage or expulsion of nose fuze 14**. The measure provided according to the invention can be implemented particularly easily and economically so that, under certain circumstances, projectiles already in storage can still be retrofitted if necessary.

What we claim is:

1. A spin stabilized payload projectile, comprising: a projectile body having a nose portion; a projectile base separately connected to the projectile body; payloads disposed for ejection in the projectile body; a nose fuze mounted in the nose portion; an ejection charge activated by the nose fuze; and a pressure reducing element disposed between the ejection charge and the nose fuze, said pressure reducing element having the shape of a cone or a cone frustum whose base face faces the nose fuze and whose tip faces the ejection charge.

2. A projectile according to claim 1, wherein the pressure reducing element has a tip with an opening.

3. A projectile according to claim 1, wherein the pressure reducing element is composed of a deformable metal.

4. A projectile according to claim 3, wherein the deformable metal is selected from the group consisting of aluminum, copper, and steel.

5. A projectile according to claim 1, wherein the tip has an opening.

6. A projectile according to claim 5, wherein the pressure reducing element is composed of a deformable metal.

* * * * *